US005181551A

United States Patent [19]

Kidd et al.

[11] Patent Number: 5,181,551

[45] Date of Patent: Jan. 26, 1993

[54] DOUBLE ACTING CYLINDER FOR FILLING DIES WITH MOLTEN METAL

[75] Inventors: Thomas F. Kidd, Toledo, Ohio; Stephen A. Thompson, St. Bruno, Canada

[73] Assignee: Electrovert Ltd., La Prairie, Canada

[21] Appl. No.: 766,551

[22] Filed: Sep. 25, 1991

[51] Int. Cl.[5] ..... B22D 17/04; B22D 37/00

[52] U.S. Cl. ..... 164/113; 164/133; 164/337; 164/312

[58] Field of Search ..... 164/133, 135, 337, 312, 164/113; 141/67; 417/418, 537

[56] References Cited

U.S. PATENT DOCUMENTS

| | | | |
|---|---|---|---|
| 1,176,862 | 3/1916 | Sims | 417/537 |
| 1,203,422 | 10/1916 | Simonson | 417/537 |
| 4,676,296 | 6/1987 | Pascoe et al. | 164/303 |
| 4,958,675 | 9/1990 | Kidd | 164/120 |
| 4,991,641 | 2/1991 | Kidd et al. | 164/120 |

*Primary Examiner*—Kuang Y. Lin
*Attorney, Agent, or Firm*—Darby & Darby

[57] ABSTRACT

A melting casting process produces meltable metal cores for subsequent molding of components made of plastic material and encapsulated components such as turbine blades so they may be held for machining. The process utilizes a double acting piston in a cylinder to permit unlimited dispensing capacity without having to pause between piston strokes. The apparatus comprises a tank for containing molten metal, a double acting cylinder having both ends closed and an injection piston therein and an operating mechanism for reciprocating the piston in the cylinder. Valve mechanisms are provided so that when the piston is moved in either direction in the cylinder, a flow of molten metal passes through an injection passageway into a die, and molten metal from the tank fills the space behind the moving piston thus the cylinder always remains full of molten metal.

26 Claims, 3 Drawing Sheets

DOUBLE ACTING CYLINDER FOR FILLING DIES WITH MOLTEN METAL

TECHNICAL FIELD

The present invention relates to a metal casting process to produce meltable metal cores for subsequent molding of components made of plastic materials, and encapsulating components such as turbine blades so they may be held for machining and other finishing steps. More specifically, the present invention relates to a double acting cylinder for producing a casting or encapsulation from molten liquid.

BACKGROUND ART

Melt out metal cores of complex shapes are made for use as cores in subsequently molded plastic components. The cores are made of metal alloy or other suitable material having a low melting temperature. Cores are placed in molds for making undercut hollow plastic components and then subsequently removed from the plastic components by melting the cores and leaving the undercut or hollow one piece plastic components. The melting temperature of the solidified metal alloy or other material is lower than that of the plastic component. In other embodiments metal alloys with low melting temperatures are used for encapsulating components such as turbine blades so they may be held for machining in other finishing steps.

In U.S. Pat. No. 4,958,675 a metal casting process is disclosed wherein the injection cylinder is filled with molten metal alloy from the tank through a valve port in the injection passageway leading to the injection cylinder by raising the piston in the cylinder. In U.S. Pat. No. 4,991,641 a similar apparatus is disclosed wherein two valves in line are positioned within the tank that forms a single assembly for ease of handling.

In our co-pending application Ser. No. 578,835 is disclosed an injection nozzle for joining a die to an injection passageway. The nozzle is flexible and also has a check valve incorporated therein so that the liquid metal flow is stopped except when the nozzle interfaces with the die.

When low temperature melt out parts or encapsulations are made, it is necessary to fill the die slowly under substantially no pressure to ensure that a uniform density and fine grain structure is achieved. Such a process is quite different from that of die casting where injection pressures are generally in the range of about 800 to 4,000 pounds per square inch and the time of injection is in the order of 30 to 40 milliseconds. In such an operation hot metals are injected at high velocity and with a turbulent flow into a die through a narrow gate. Air or other gases can sometimes become entrapped and pressures build up in the cylinder and injection passageway. These high speed injection processes generally include runners leading into the die and the unsolidified metal drains back after the casting process.

Melt out metal parts are generally made from metal alloys having a melting temperature below 350° C. High pressure die casting generally uses metals with much higher melting temperatures, and such pressures are not appropriate for making melt out metal parts or encapsulations because the desired dimension tolerances and freedom from voids cannot be achieved. Castings of melt out metal alloys are generally produced by allowing liquid metal alloy to flow into a die under substantially no pressure. After the die is full, a small pressure generally in the order of 30 to 50 pounds per square inch is built up in the die during the cooling stage. The filling and cooling time can vary from about 3 to 30 seconds depending upon the capacity of the die.

DISCLOSURE OF INVENTION

It is an aim of the present invention to provide a double acting piston and cylinder so that multiple stroking metal dispensing can occur from a molten metal tank. Multiple stroking permits indefinite cylinder capacity. The piston may be reversed to continue filling the die with substantially no pause for refilling the cylinder. In the known processes of low temperature metal casting where a single acting cylinder limits the quantity of metal alloy dispensed, it was sometimes necessary to have more than one stroke to fill a die. There was always a time delay between strokes because it was necessary to refill the cylinder each time. This time delay resulted in a join line or mark occurring in the casting or encapsulation where the new metal from the next stroke joined metal from the previous stroke. In the present application, there is substantially no time delay between strokes so no join line or mark occurs.

The double acting cylinder permits the piston to fill a die from molten metal in the cylinder, while at the same time filling the cylinder on the other side of the piston. Furthermore, the present invention provides an apparatus for filling a die which has more capacity than a single acting cylinder. A single stroke may be used to fill a die or, alternatively, multiple bidirectional strokes may be used to fill a die, thus the machine is suitable for substantially any size of die.

In another embodiment there is provided an apparatus for filling a die with molten metal with valves positioned above the injection cylinder but still within the molten metal tank. This provides easier access to the valves for maintenance. Furthermore, the nozzle attachment on the end of the injection passageway may be positioned above the molten metal level in the tank which prevents leakage of molten metal if a valve should fail to close. In yet another embodiment, a check valve is arranged within the nozzle attachment to interface with the die. Thus, when the nozzle attachment is separated from the die, the check valve closes and there is always molten metal present at the tip of the nozzle outlet regardless of fluctuations of molten metal level in the tank. The check valve in the nozzle attachment acts as a safety valve to prevent molten metal escaping when the nozzle attachment is separated from the die.

The present invention provides an apparatus for filling a die with molten metal comprising: a tank adapted to contain molten metal, a double acting cylinder having both ends closed and an injection piston therein, means to reciprocate the piston in the cylinder, first passage means from one end of the cylinder to a first valve having a first opening to the tank and a second opening to an injection passageway leading to a die, the first valve having a first position wherein the first opening to the tank is open and the second opening to the injection passageway is closed, and a second position wherein the first opening to the tank is closed and the second opening to the injection passageway is open, first valve operating means to transfer between the first position and the second position of the first valve, second passage means from the other end of the cylinder to a second valve having a first opening to the tank and a second opening to the injection passageway, the second valve having a first position wherein the first opening to the tank is open and the second opening to the injection passageway is closed, and a second position wherein the first opening to the tank is closed and the second opening to the injection passageway is open, second valve operating means to transfer between the first position and the second position of the second valve, and control means for the means to reciprocate the piston in the cylinder, and for the first valve operating means and the second valve operating means to fill the die with the molten metal.

In another embodiment there is provided a method of producing a casting or encapsulation from molten metal or the like, including a double acting cylinder located within a tank containing molten metal, the cylinder having both ends closed and an injection piston therein, means to reciprocate the piston in the cylinder, first passage means from one end of the cylinder to a first valve means with a first opening to the tank and a second opening to an injection passageway leading to a die, second passage means from the other end of the cylinder to a second valve means with a first opening to the tank and a second opening to the injection passageway leading to the die, the method comprising the steps of: closing the first opening to the tank in the first valve means and opening the second opening from the first passage means to the injection passageway, opening the first opening to the tank in the second valve means and closing the second opening from the second passage means to the injection passageway, moving the piston towards the one end of the cylinder having the first passage means therein to draw molten metal into the cylinder through the second passage means and inject molten metal into the die through the first passage means and the injection passageway.

In a further embodiment there is provided a method of producing a casting or encapsulation from a molten metal or the like including: a double acting cylinder located within a tank containing molten metal, the cylinder having first and second closed ends and an injection piston connected to a piston rod extending through the first end of the cylinder, means to reciprocate the piston in the cylinder, first passage means from the first end of the cylinder to a first valve means with a first opening to the tank and a second opening to an injection passageway leading to a die, second passage means from the second end of the cylinder to a second valve means with a first opening to the tank and a second opening to the injection passageway leading to the die, the method comprising the steps of: filling the cylinder with molten metal through the second passage means with the piston adjacent the first end of the cylinder, closing the first openings to the tank in the first valve means and the second valve means, and opening the second openings from the first passage means and the second passage means to the injection passageway, moving the piston towards the second end of the cylinder to inject molten metal into the die through the second passage means and the injection passageway and recirculate molten metal through the second passage means and the first passage means into the cylinder on the other side of the piston.

BRIEF DESCRIPTION OF DRAWINGS

In drawings which illustrate embodiments of the present invention.

MODES FOR CARRYING OUT THE INVENTION

Figure 2:
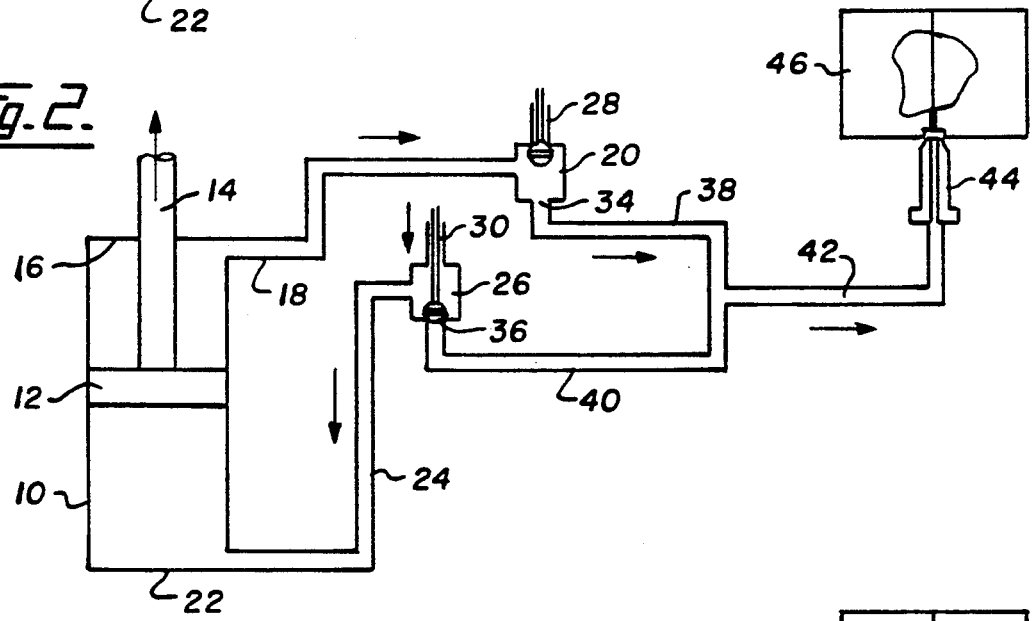
Figure 3:
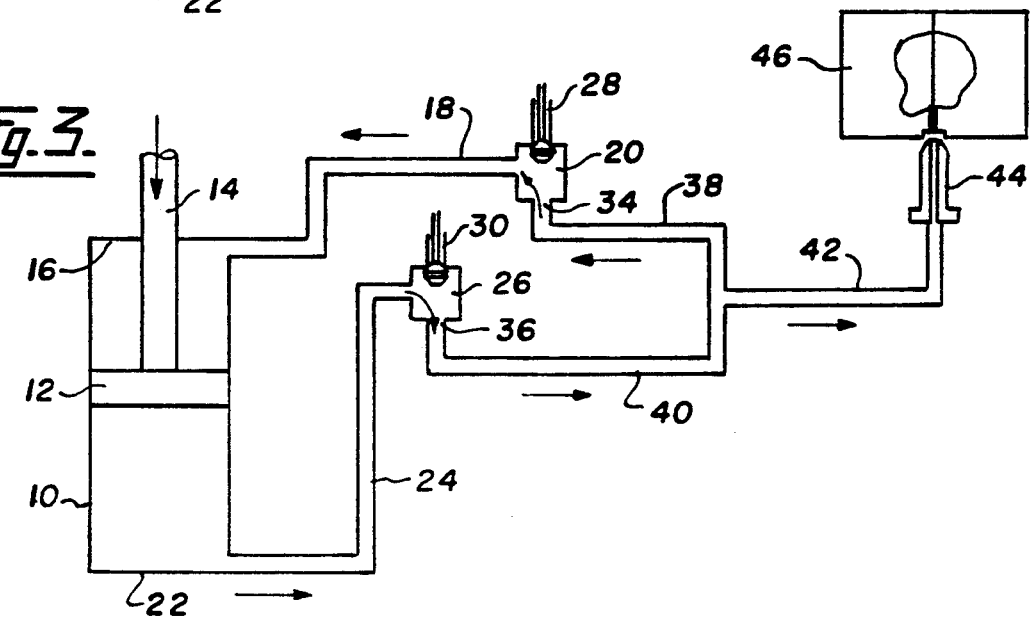
Figure 4:
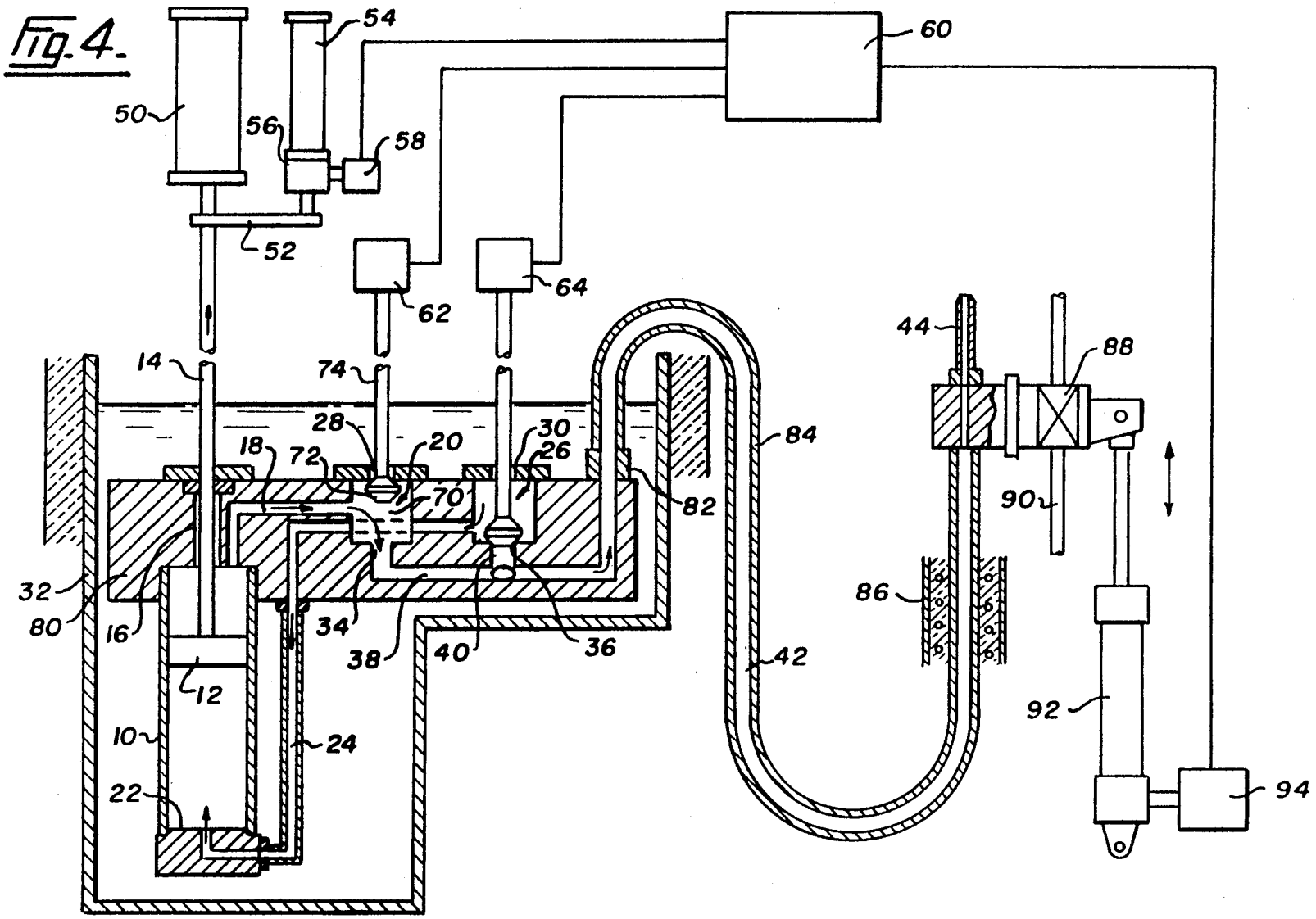
FIG. 4 is a detailed schematic diagram showing the cylinder and valves within a tank and an engageable and disengageable nozzle attachment to a die.

Referring to FIGS. 1 to 4, a double acting cylinder 10 is shown having a piston 12 attached to a piston rod 14 for reciprocating within the cylinder 10. The cylinder 10 has a first end 16 through which the piston rod 14 extends and a first passage 18 leading from the first end 16 to a first valve 20. A second end 22 of the cylinder 10 has a second passage 24 leading to a second valve 26. The first valve 20 and the second valve 26 have first opening ports 28 and 30 respectively which open into a molten metal tank 32 as shown in FIG. 4. Whereas the molten metal tank is not shown in FIGS. 1, 2 and 3, this tank is omitted for ease of illustration. However, the first opening ports 28 and 30 from the first valve 20 and the second valve 26 open under the molten metal level within the tank 32 so that molten metal enters the valves.

Second opening port 34 in the first valve 20 and second opening port 30 in the second valve 26 connect to passageways 38 and 40 respectively which join into an injection passageway 42 leading to a nozzle attachment 44 which in turn connects to a die 46.

As shown in more detail in FIG. 4, the piston 12 is attached to the piston rod 14 which moves up and down powered by a pneumatic cylinder 50. The cylinder 50 is double acting and has adjacent to it and joined by a bridge 52, a hydraulic cylinder 54 with a hydraulic valve 56 having a stepper motor 58 to open and close the hydraulic valve 56 and thus effect speed control of the piston 12. This provides a variable speed piston stroke in both directions. The pneumatic cylinder 50 powers the piston in both directions and the speed of the piston is set by the stepper motor 58. A microprocessor 60 operates the pneumatic cylinder 50, controls the speed of the piston 12 in the cylinder 10 by the stepper motor 58 and operates a first solenoid operator 62 for the first valve 20 and a second solenoid operator 64 for the second valve 26 to ensure the correct sequence of steps occurs in the casting process.

The pneumatic cylinder 50 controls the pressure applied to the piston 12, so that the pressure is sufficient to push the molten metal into the die 46 so that there is substantially no pressure in the die, just sufficient to replace the air in the die 46. Whereas a pneumatic cylinder 50 and stepper motor 50 are shown to control the speed and pressure of the piston 12 in the cylinder 10, it will be apparent to those skilled in the art that a mechanical equivalent system with a pressure relief mechanism in the injection passageway 42 or the other passages may be provided. The system controls speed of the piston 12 to ensure the filling occurs at the required rate, and pressure on the piston so there is no build up of pressure in the die during the injection step and a predetermined pressure is maintained on the piston 12 after the injection step while the metal solidifies.

Each of the valves 20 and 26 has a valve chamber 70 in which a cylindrical valve member 72 with sealing faces at top and bottom, is supported by a valve stem 74 and moves from a first position where the valve member 72 closes the first port 28,30 about the stem 74, and a second position wherein the valve member 72 closes the second port 34,36. The valve member 72 is moved by the solenoid operator 62,64 attached to the stem 74.

The cylinder 10 is shown incorporated into one assembly 80 having the first valve 20 and the second valve 26 built therein. Thus, the piston rod 14 and the two valve stems 74 extend up above the level of molten metal in the tank. The valves 20 and 26 are positioned above the cylinder 10 and, as can be seen, the cylinder is shown to be mounted with a vertical axis. Whereas a vertical axis is shown herein it would be apparent that the cylinder need not be mounted vertically but may be at an angle or horizontally, depending upon the specific requirements of the machine itself. For instance, a shallower tank could be provided if the cylinder was positioned horizontally.

The integral valve assembly 80 has the first passage 18 from the first end 16 of the cylinder 10 therein and also a portion of the second passage 24 from the second end 22 of the cylinder 10. Furthermore, the injection passageway 42 extends to a connector 82 which in turn is connected to a flexible hose 84 The flexible hose is insulated and has heating coils 86 surrounding it, thus it is kept at an even temperature to ensure that the molten metal does not cool while being transferred from the tank 32 to the die.

In the embodiment shown the nozzle attachment 44 is mounted on a support arm 88 adapted to move vertically up and down on shaft 90. Hydraulic cylinder 92 connected to the support arm 88 moves the nozzle attachment 44 up and down and a control valve 94 is operated by the microprocessor 60 to ensure the movement of the nozzle attachment 44 is controlled to match the movement of the piston 12 and valves 20 and 26.

Figure 5:
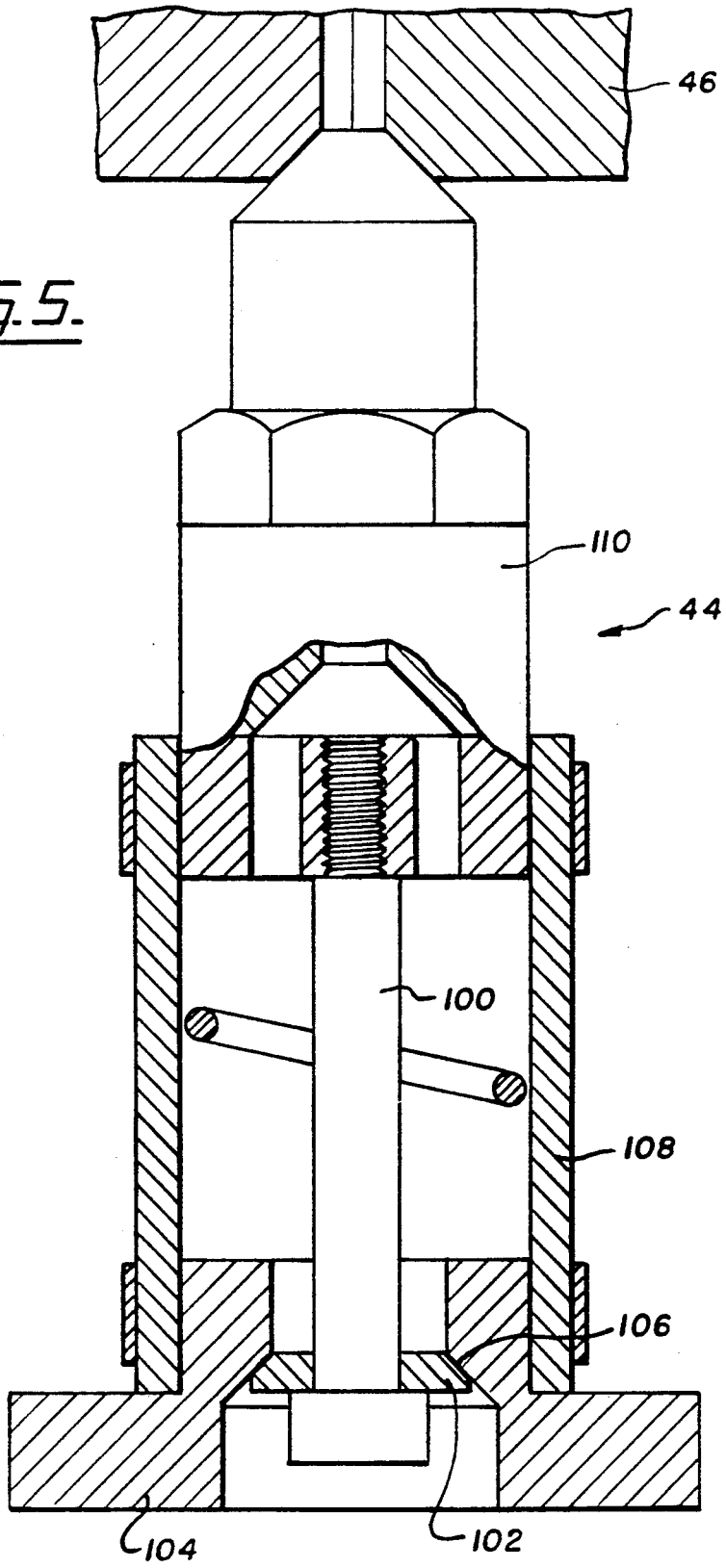
FIG. 5 is a sectional view of a nozzle attachment with a valve therein.

In the embodiment shown in FIG. 5, a nozzle attachment 44 of the type disclosed in U.S. patent application Ser. No. 578,835 is shown. The nozzle attachment 44 has an internal stem 100 connected to a valve seat member 102. A base 104 of the nozzle attachment has a seat 106 onto which the valve member 102 seals. A flexible sleeve 108 joins the base 104 to a top portion 110, and a spring 112 holds the valve closed when the nozzle attachment is not in contact and being pushed upwards to engage the die 46. When the nozzle attachment is engaged in the die 46, then the sleeve 108 being flexible permits the stem 100 to move downwards and thus the valve opens to permit molten metal to pass through the nozzle attachment to the die.

Figure 1:
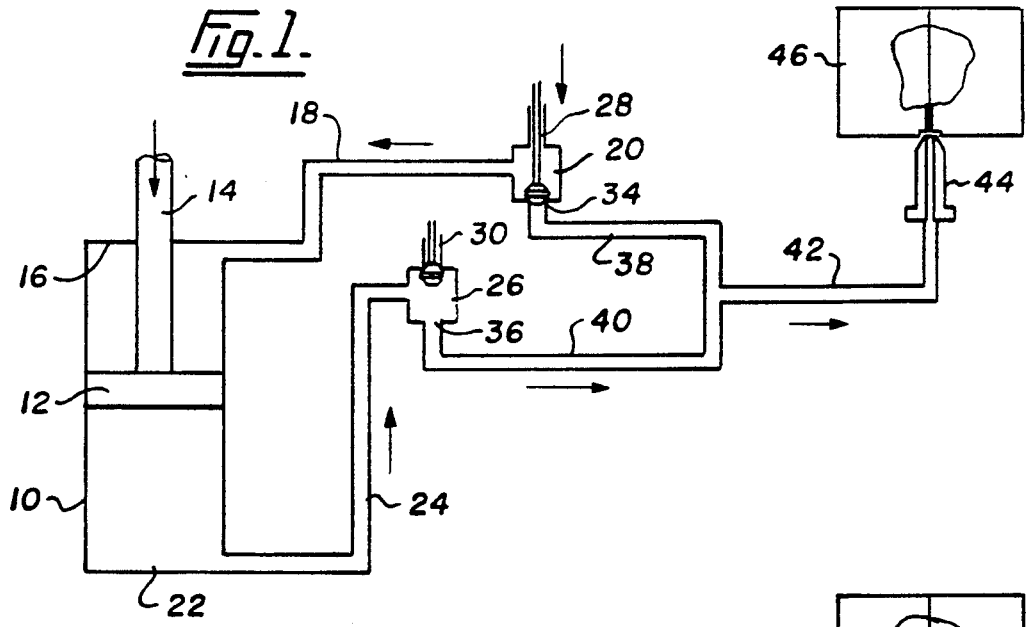
FIGS. 1, 2 and 3 are schematic diagrams depicting an apparatus for filling a die with molten metal, the valves being in different positions for different injection strokes.

The operation of the double acting cylinder is illustrated in FIGS. 1, 2 and 3. In FIG. 1 the first valve 20 is shown in the second position with the first port 28 to the tank 32 open and the second port 34 closed, thus as the piston 12 moves downwards, molten metal is drawn through the first port 28 of the first valve 20, along the first passage 18 and into the cylinder 10 above the piston 12. At the same time the second valve 26 has the first port 30 to the tank 32 closed and the second port 36 to the injection passageway 42 open. Thus, molten metal is pushed along the second passage 24 through the second valve 26 into the injection passageway 42 and through the nozzle attachment 44 to the die 46. The volume of molten metal which is pushed through the injection passageway is equivalent to the area of the piston 12 times the piston stroke.

In FIG. 2 the first valve 20 is shown with the first port 28 closed and the second port 34 open. The second valve 26 is shown with the second port 36 closed and the first port 30 open, therefore, as the piston 12 rises, molten metal is pulled from the tank 32 through the first port 30 of the second valve 26, and the second passage 24 to fill up the cylinder beneath the piston 12. At the same time, molten metal is forced through the first passage 18, the first valve 20 and the injection passageway 42 to the die 46. The volume of metal that is be forced out of the cylinder 10 in this stroke is representative of the area of the piston 12 minus the area of the piston rod 14 times the piston stroke.

In FIG. 3 a third provision is made wherein the piston 12 is initially at the top of the cylinder 10. The cylinder is full of molten metal and both the first valve 20 and the second valve 26 have the first ports 28 and 30 to the tank 32 closed. When the piston 12 moves downwards, molten metal passes along the second passage 24 through the second valve 26 into passageway 40. A portion of molten metal passes through the injection passageway 42 to the die 46 and the other portion of molten metal passes through passageway 38, first valve 20, first passageway 18 and into the top of the cylinder 10. In this stroke the volume of molten metal passed to the die 46 is equivalent to the cross-sectional area of the piston rod 14 times the piston stroke. The injection step shown in FIG. 3 provides a small flow of molten metal through the injection passageway and is used for small die capacities, as the movement of the piston produces a far smaller flow than shown in FIGS. 1 and 2.

The nozzle attachment 44 as shown in FIG. 4 is positioned above the level of molten metal in the tank 32. Thus, should any of the valves 20, 26 or the valve in the nozzle attachment 44 fail to close, molten metal does not flow out of the nozzle attachment 44. Under normal operations, the injection passage 42 and all the passages within the tank remain full of molten metal. Even that portion of the injection passage 42 above the level of the molten metal in the tank 32 remains full when the valve provided in the nozzle attachment 44 is closed.

A single piston stroke may be used to fill a die 46 in one embodiment. However, in other embodiments two or more piston strokes may be used or portions of a piston stroke. This enables different sizes of die to be utilized with the same equipment. There are three different capacities of molten metal delivery for the piston strokes as explained and illustrated in FIGS. 1, 2 and 3. Furthermore, by reversing movement of the piston, there is essentially no pause to refill the cylinder. When a die 46 is filled, then provision is made for pressure to be maintained on the piston 12 so that the molten metal solidifies under pressure. The die 46 fills preferably within a time of about 3 to 30 seconds and a flow rate of molten metal into the die is preferably in the range of about 0.01 to 1 kilogram per second. Substantially no pressure is required in the die during the filling step, however, once the die has been filled, then pressure is applied during the solidifying stage. Molten metal alloys for encapsulation and for use in meltable metal cores preferably has a melting temperature below about 350° C.

Various changes may be made to the embodiments shown herein without departing from the scope of the present invention which is limited only by the following claims.

The embodiments of the present invention in which an exclusive property or privilege is claimed are defined as follows.

1. An apparatus for filling a die with molten metal comprising:

a tank adapted to contain molten metal;

a double acting cylinder having both ends closed and an injection piston therein;

means to reciprocate the piston in the cylinder;

first passage means from one end of the cylinder to a first valve having a first opening to the tank and a second opening to an injection passageway leading to a die;

the first valve having a first position wherein the first opening to the tank is open and the second opening to the injection passageway is closed, and a second position wherein the first opening to the tank is closed and the second opening to the injection passageway is open;

first valve operating means to transfer between the first position and the second position of the first valve;

second passage means from the other end of the cylinder to a second valve having a first opening to the tank and a second opening to the injection passageway;

the second valve having a first position wherein the first opening to the tank is open and the second opening to the injection passageway is closed, and a second position wherein the first opening to the tank is closed and the second opening to the injection passageway is open;

second valve operating means to transfer between the first position and the second position of the second valve, and control means for the means to reciprocate the piston in the cylinder, and for the first valve operating means and the second valve operating means to fill the die with molten metal.

2. The apparatus according the claim 1 wherein the control means provides a flow rate of molten metal filling the die so that the die fills within a time of about 3 to 35 seconds.

3. The apparatus for filling a die according to claim 2 wherein the control means maintains pressure on the piston after the die has been filled to maintain the molten metal under pressure during cooling.

4. The apparatus for filling a die according to claim 1 wherein the cylinder and first and second valves are located within the tank.

5. The apparatus for filling a die according to claim 4 wherein the first and second valves are positioned at an elevation higher than the cylinder.

6. The apparatus for filling a die according to claim 1 wherein the first and second valves are incorporated within a single assembly contained within the tank.

7. The apparatus for filling a die according to claim 1 wherein the first and second valves are stem type reciprocating valves with the first opening at the top around a stem, and the second opening at the base.

8. The apparatus for filling a die according to claim 1 wherein the injection passageway terminates at a nozzle attachment for connection to the die with a nozzle outlet positioned at an elevation higher than molten metal level in the tank.

9. The apparatus for filling a die according to claim 1 wherein the injection passageway comprises a heated flexible hose terminating in a nozzle attachment for connection to the die.

10. The apparatus for filling a die according to claim 9 including engaging and disengaging means for the nozzle attachment to connect to the die.

11. The apparatus for filling a die according to claim 9 wherein the nozzle attachment has a check valve therein.

12. A method of producing a casting or encapsulation from molten metal or the like, including:

a double acting cylinder located within a tank containing molten metal, the cylinder having both ends closed and an injection piston therein, means to reciprocate the piston in the cylinder, first passage means from one end of the cylinder to a first valve means with a first opening to the tank and a second opening to an injection passageway leading to a die, second passage means from the other end of the cylinder to a second valve means with a first opening to the tank and a second opening to the injection passageway leading to the die, the method comprising the steps of:

closing the first opening to the tank in the first valve means and opening the second opening from the first passage means to the injection passageway;

opening the first opening to the tank in the second valve means and closing the second opening from the second passage means to the injection passageway;

moving the piston towards the one end of the cylinder having the first passage means therein to draw molten metal into the cylinder through the second passage means and inject molten metal into the die through the first passage means and the injection passageway.

13. The method of producing a casting or encapsulation according to claim 12 including the steps of:

stopping the piston at an end of a piston stroke;

opening the first opening to the tank in the first valve means and closing the second opening from the first passage means to the injection passageway;

closing the first opening to the tank in the second valve means and opening the second opening from the second passage means to the injection passageway;

moving the piston towards the other end of the cylinder having the second passage means therein to draw molten metal into the cylinder through the first passage means and inject molten metal into the die through the second passage means and the injection passageway, and stopping the piston at the end of a piston stroke and repeating the proceeding steps.

14. The method of producing a casting or encapsulation according to claim 12 wherein there is a molten metal flow of about 0.01 to 1 kg per second to fill the die.

15. The method of producing a casting or encapsulation according to claim 14 wherein the die is filled within a time of about 3 to 30 seconds.

16. The method of producing a casting or encapsulation according to claim 14 wherein substantially no pressure is applied to molten metal in the die when the die is being filled.

17. The method of producing a casting or encapsulation according to claim 16 wherein pressure is applied to molten metal in the die after the die is filled to maintain the molten metal under pressure during cooling.

18. The method of producing a casting or encapsulation according to claim 12 wherein more than one piston stroke is required to fill the die.

19. The method of producing a casting or encapsulation according to claim 12 wherein the molten metal is a molten metal alloy having a melting temperature below about 350° C.

20. A method of producing a casting or encapsulation from molten metal or the like, including:

a double acting cylinder located within a tank containing molten metal, the cylinder having first and second closed ends and an injection piston connected to a piston rod extending through the first end of the cylinder, means to reciprocate the piston in the cylinder, first passage means from the first end of the cylinder to a first valve means with a first opening to the tank and a second opening to an injection passageway leading to a die, second passage means from the second end of the cylinder to a second valve means with a first opening to the tank and a second opening to the injection passageway leading to the die, the method comprising the steps of:

filling the cylinder with molten metal through the second passage means with the piston adjacent the first end of the cylinder;

closing the first openings to the tank in the first valve means and the second valve means, and opening the second openings from the first passage means and the second passage means to the injection passageway;

moving the piston towards the second end of the cylinder to inject molten metal into the die through the second passage means and the injection passageway and recirculate molten metal through the second passage means and the first passage means into the cylinder on the other side of the piston.

21. The method of producing a casting or encapsulation according to claim 20 wherein there is a molten metal flow of about 0.01 to 1 kg per second to fill to die.

22. The method of producing a casting or encapsulation according to claim 21 wherein the die is filled within a time of about 3 to 30 seconds.

23. The method of producing a casting or encapsulation according to claim 21 wherein substantially no pressure is applied to molten metal in the die when the die is being filled.

24. The method of producing a casting or encapsulation according to claim 23 wherein pressure is applied to molten metal in the die after the die is filled to maintain the molten metal under pressure during cooling.

25. The method of producing a casting or encapsulation according to claim 20 wherein more than one piston stroke is required to fill the die.

26. The method of producing a casting or encapsulation according to claim 20 wherein the molten metal is a molten metal alloy having a melting temperature below about 350° C.

* * * * *